US009899011B2

(12) United States Patent
Gallo et al.

(10) Patent No.: US 9,899,011 B2
(45) Date of Patent: Feb. 20, 2018

(54) GUITAR SUPPORT ASSEMBLY

(71) Applicants: James Gallo, Henderson, NV (US); Rocco Gallo, Henderson, NV (US)

(72) Inventors: James Gallo, Henderson, NV (US); Rocco Gallo, Henderson, NV (US)

( * ) Notice: Subject to any disclaimer, the term of this patent is extended or adjusted under 35 U.S.C. 154(b) by 97 days.

(21) Appl. No.: 15/058,435

(22) Filed: Mar. 2, 2016

(65) Prior Publication Data

US 2017/0256244 A1 Sep. 7, 2017

(51) Int. Cl.
*G10G 5/00* (2006.01)

(52) U.S. Cl.
CPC ..... *G10G 5/00* (2013.01)

(58) Field of Classification Search
CPC ..... G10G 5/00
USPC ..... 248/111, 443, 300, 459, 314, 346.11, 248/312.1; 84/327, 329, 453; 984/257; D6/682; D17/20
See application file for complete search history.

(56) References Cited

U.S. PATENT DOCUMENTS 2,616,647 A * 11/1952 Murchison ..... A45D 27/29 248/110
2,974,703 A * 3/1961 Rapata ..... B60Q 1/0683 174/153 G
D217,225 S * 4/1970 Fitzsimmons ..... D8/373
3,521,332 A * 7/1970 Kramer ..... F16B 2/22 248/229.26
3,664,224 A 5/1972 Campagna, Jr.
3,765,633 A * 10/1973 Caudill ..... G10G 5/00 24/457
3,804,031 A * 4/1974 Pitts ..... A47B 31/06 108/44
D242,966 S * 1/1977 MacMillan ..... D2/642
4,084,778 A * 4/1978 Dominguez ..... G10G 5/00 248/300
4,176,580 A * 12/1979 Gallegos ..... G10G 5/00 248/224.51
4,205,818 A * 6/1980 Lawler ..... A47B 19/002 211/85.6
4,345,732 A * 8/1982 Gallegos ..... G10G 5/00 248/201
D270,120 S 8/1983 McPherson, Sr.
4,474,290 A * 10/1984 DeMato ..... G10G 7/005 206/14
4,546,688 A 10/1985 Cuccio
D283,032 S * 3/1986 Quesnel ..... D17/20
D289,732 S * 5/1987 Jason ..... D8/356
(Continued)

OTHER PUBLICATIONS

Tina's Pick Collection, Website: www.Tina'spicks.com, Jun. 17, 2012.*

*Primary Examiner* — Jonathan Liu
*Assistant Examiner* — Guang H Guan

(57) ABSTRACT

A guitar support assembly engages a handle of an amplifier and receives a neck of a guitar. The guitar support assembly includes a body that has an upper surface and a lower surface. The body is bound by a perimeter edge that has a front side, a rear side, a first lateral side and a second lateral side. The front side has a notch that receives the neck of the guitar or another string instrument. A tab is attached to the rear side and extends away from the body. The tab is spaced from the first lateral side and the second lateral side. The body is situated on the amplifier such that the notch receives the neck of the guitar and retains the guitar in a vertical position.

1 Claim, 5 Drawing Sheets

(56) References Cited

U.S. PATENT DOCUMENTS 4,749,161 A * 6/1988 Falcone ..... B60N 3/005 108/44
4,991,809 A 2/1991 Harkey
D325,595 S * 4/1992 Tornese ..... D17/20
5,249,108 A * 9/1993 Gary ..... F21V 21/14 248/231.9
5,346,073 A * 9/1994 Broersma ..... G10G 5/00 211/85.6
D366,147 S * 1/1996 Marks ..... D22/138
5,535,682 A * 7/1996 Aigeldinger ..... A47B 3/08 108/129
D389,050 S * 1/1998 Li ..... D8/395
6,179,135 B1 * 1/2001 Simpson ..... G10G 5/00 211/85.6
6,196,397 B1 * 3/2001 Maher ..... A47B 81/00 211/70.5
D444,706 S * 7/2001 Giancaspro ..... D3/229
D482,904 S * 12/2003 Slaymaker ..... D6/310
6,745,509 B1 * 6/2004 Lapp ..... G09F 23/00 40/661
6,835,883 B2 * 12/2004 Stevens ..... F16M 11/22 84/327
7,351,896 B2 * 4/2008 Clifford ..... G10G 5/00 84/327
7,446,249 B2 * 11/2008 Driscoll ..... G10G 5/00 84/327
7,541,529 B1 * 6/2009 Blair ..... G10G 5/00 224/257
7,579,537 B2 * 8/2009 Lippert ..... G10G 5/00 84/327
7,772,471 B2 * 8/2010 Bustamante ..... G10G 5/00 84/327
7,777,110 B2 * 8/2010 Wallis ..... G10G 5/00 248/443
8,020,817 B2 * 9/2011 Yu ..... G10G 5/00 248/125.8
D754,459 S * 4/2016 Wilton ..... D6/682.3
2005/0000348 A1 1/2005 Workman
2005/0121567 A1 * 6/2005 Meuniot ..... F16M 13/00 248/150
2006/0032359 A1 * 2/2006 Smith ..... G10G 5/00 84/327
2008/0028913 A1 * 2/2008 Driscoll ..... G10G 5/00 84/327
2009/0151538 A1 * 6/2009 Lippert ..... G10G 5/00 84/327
2009/0277320 A1 * 11/2009 Wallis ..... G10G 5/00 84/327
2010/0181441 A1 * 7/2010 Yu ..... G10G 5/00 248/121
2017/0256244 A1 * 9/2017 Gallo ..... A47G 23/0225

* cited by examiner

GUITAR SUPPORT ASSEMBLY

BACKGROUND OF THE DISCLOSURE

Field of the Disclosure

The disclosure relates to support devices for guitars and other string instruments and more particularly pertains to a new guitar support assembly that engages the handle of an amplifier, receives the neck of a guitar and retains the guitar in vertical orientation.

SUMMARY OF THE DISCLOSURE

An embodiment of the disclosure meets the needs presented above by generally comprising a body that has an upper surface and a lower surface. The body is bound by a perimeter edge that has a front side, a rear side, a first lateral side and a second lateral side. The front side has a notch that is configured for receiving a neck of a guitar. A tab is attached to the rear side and extends away therefrom. The tab is spaced from each of the first lateral side and the second lateral side. The body is positioned on the amplifier such that the notch receives the neck of a guitar and retains the guitar in vertical orientation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
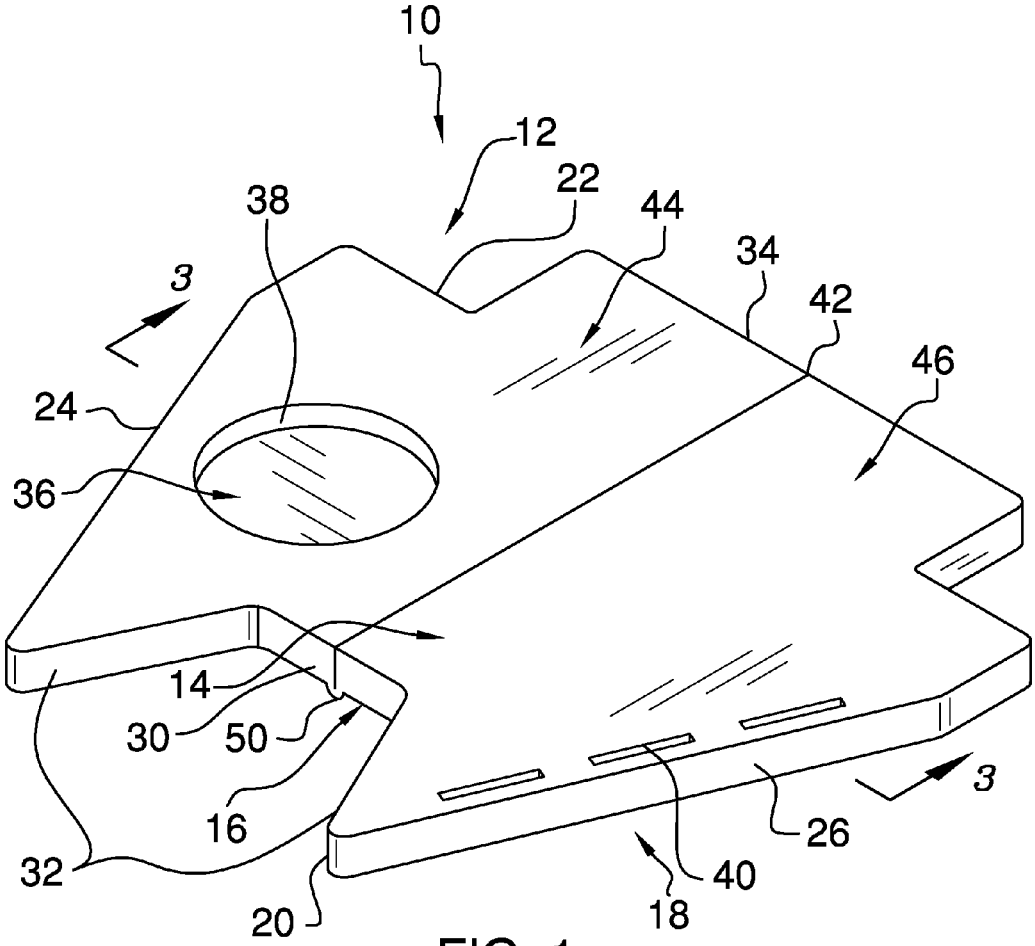
FIG. 1 is a front isometric view of a guitar support assembly according to an embodiment of the disclosure.
Figure 2:
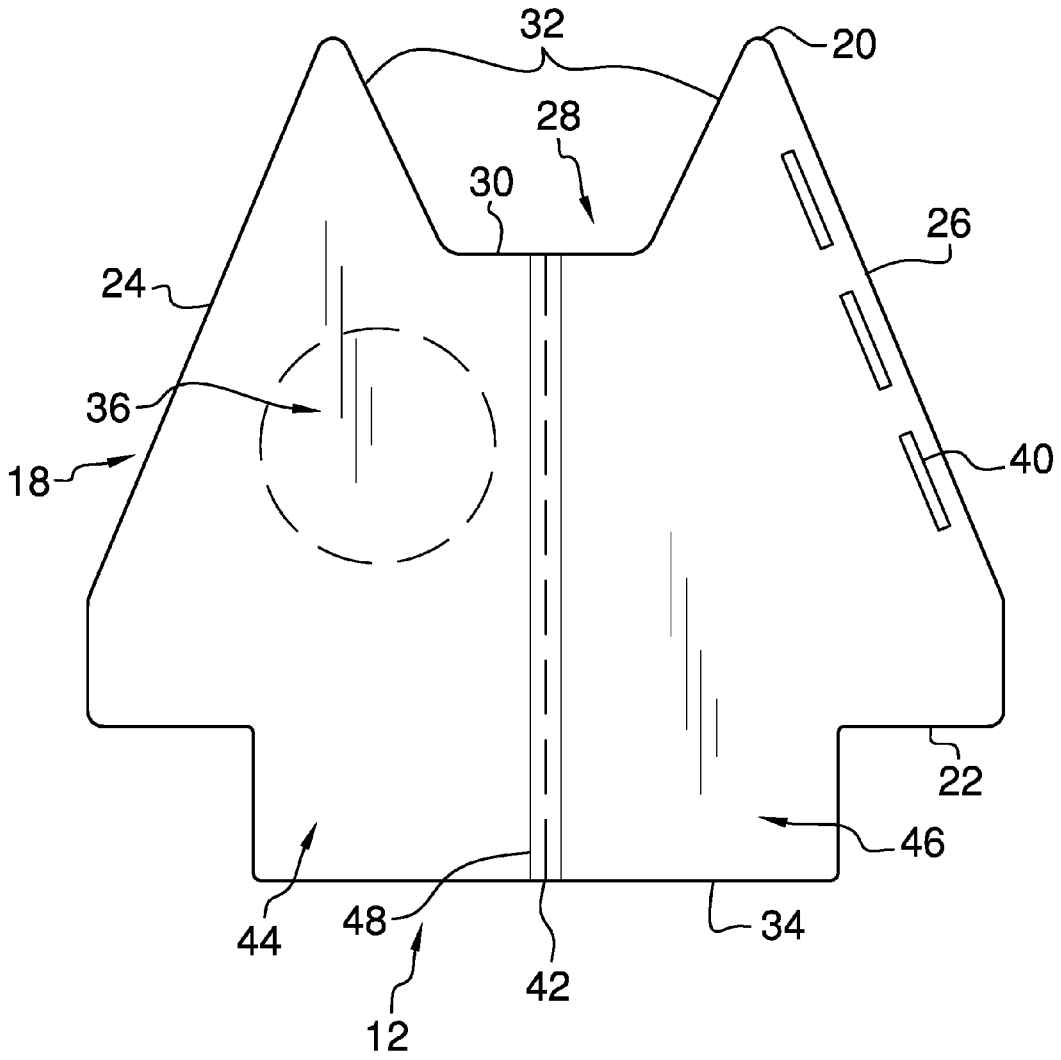
FIG. 2 is a bottom view of an embodiment of the disclosure.
Figure 3:
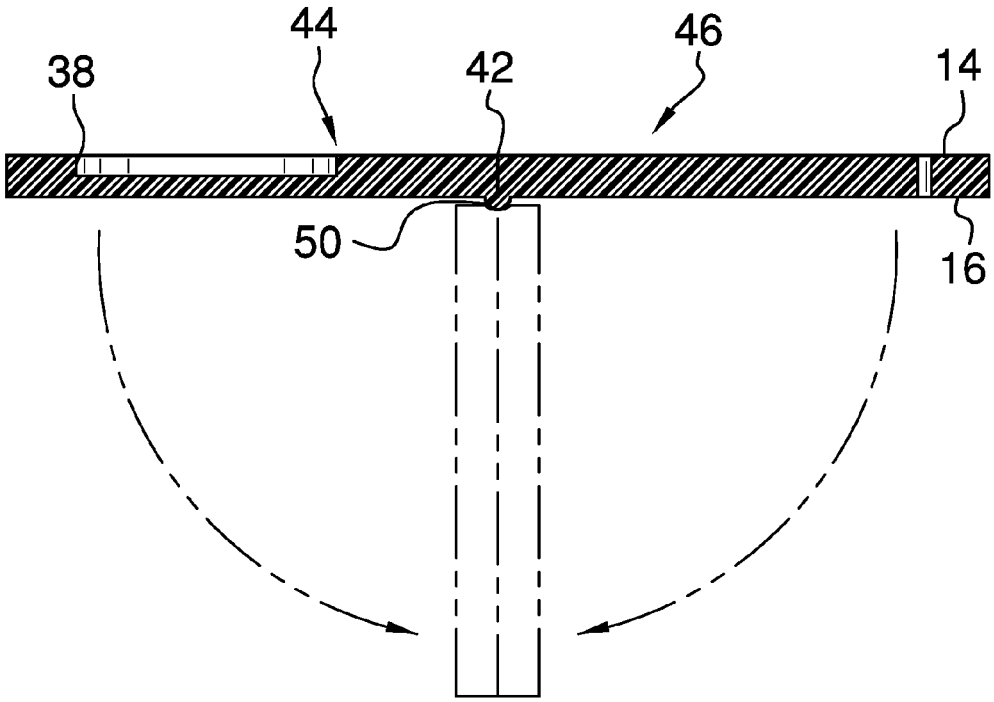
FIG. 3 is a cross-sectional view of an embodiment of the disclosure.
Figure 4:
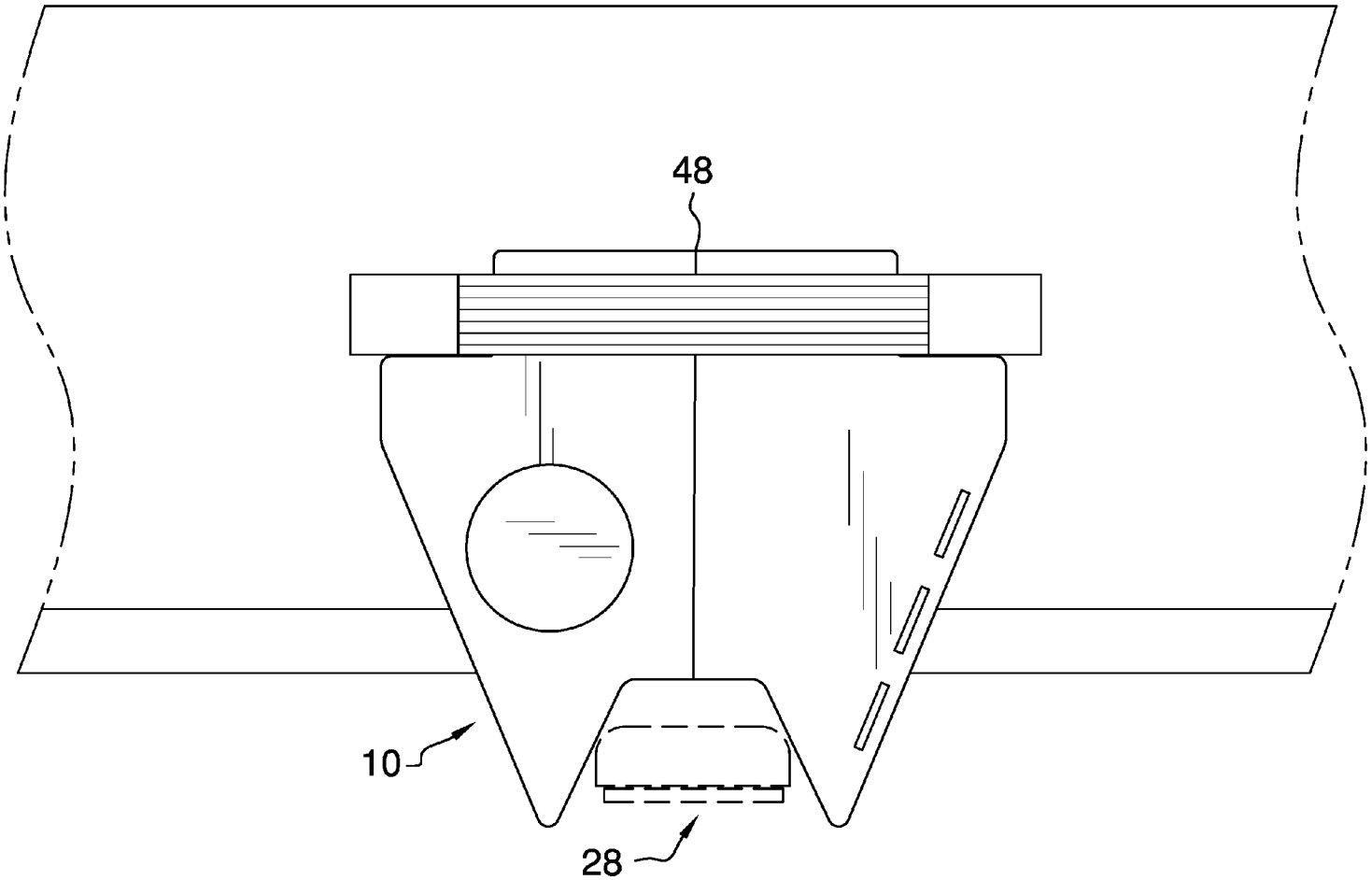
FIG. 4 is a top view of an embodiment of the disclosure.
Figure 5:
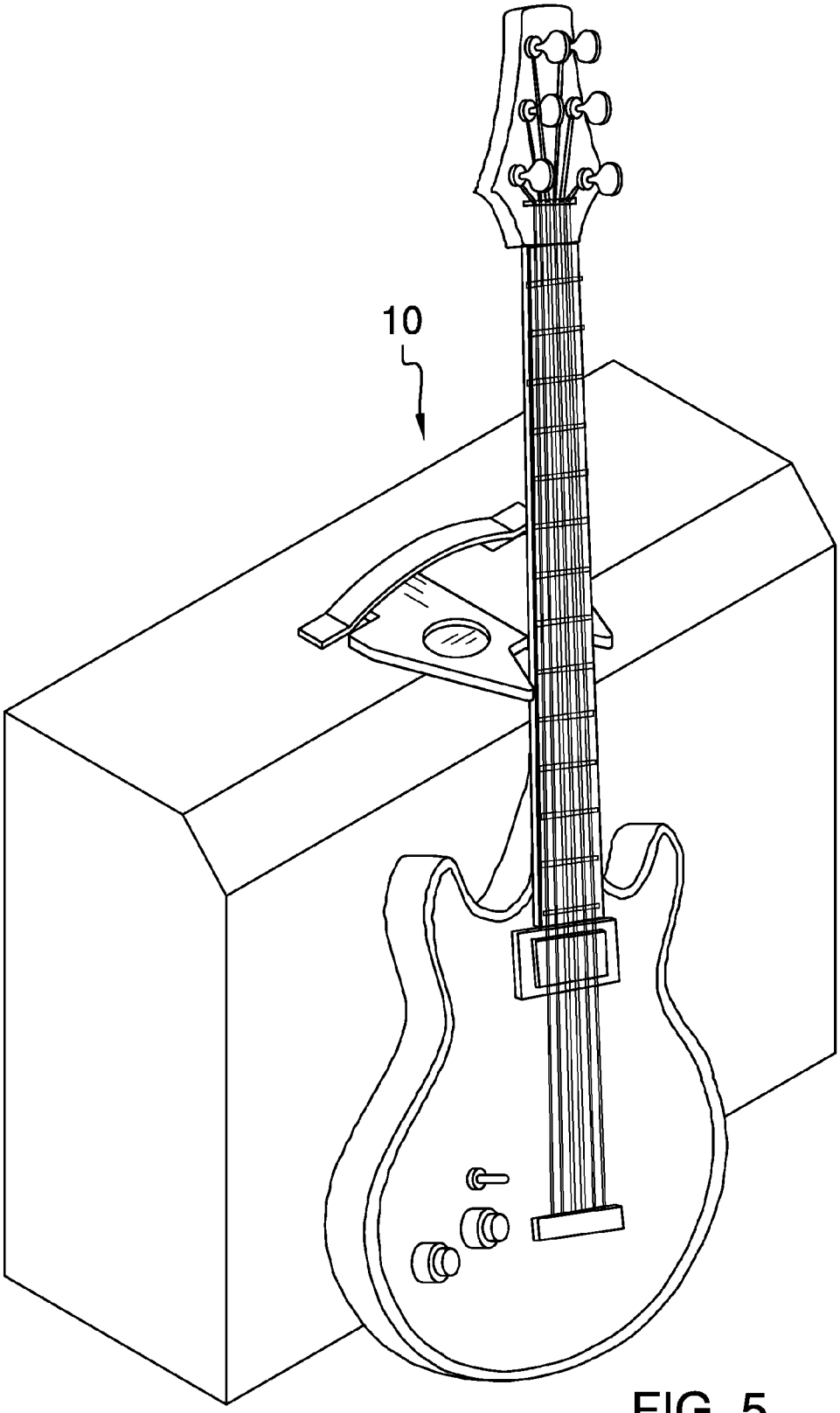
FIG. 5 is a perspective in-use view of an embodiment of the disclosure.

With reference now to the drawings, and in particular to FIGS. 1 through 5 thereof, a new guitar support assembly embodying the principles and concepts of an embodiment of the disclosure and generally designated by the reference numeral 10 will be described.

As best illustrated in FIGS. 1 through 5, the guitar support assembly 10 generally comprises a body 12 has an upper surface 14 and a lower surface 16. The body 12 has a perimeter edge 18 that has a front side 20, a rear side 22, a first lateral side 24 and a second lateral side 26. The front side has a notch 28 that has an inner side 30 and a pair of side sides 32 tapering outwardly from the inner side 30 to the front side 20. The notch 28 in the front side 20 configured for receiving a neck of a guitar. The upper 14 and lower 16 surfaces of the body 12 are planar. The first 24 and second 26 lateral sides taper toward each other from the rear side 22 to the front side 20. The body 12 is made of an elastomeric material such as rubber or some forms of plastic, and can be rigid or semi-rigid. A tab 34 is attached to the rear side 22 and extends away from the rear side 22. The tab 34 is spaced from each of the first lateral side 24 and the second lateral side 26. The tab 34 is co-planar with the body 12 and it engages a handle of an amplifier. Thus, the tab 34 is retained between the handle and the amplifier.

A recess 36 extends downwards into the upper surface 14 of the body 12. The recess 36 is positioned close to the first lateral side 24 and is configured to receive a beverage container. The recess 36 has a bounding surface 38 that is continuous and may be cylindrical in shape. The bounding surface 38 of the recess 36 may be lined with hygroscopic material. The bounding surface 38 has a surface area of at least 10 inches. A plurality of slots 40 is organized in a straight line on the upper surface 14 of the body 12. Each of the slots 40 can receive a guitar pick and this row of slots 40 is positioned close to the second lateral side 26.

A medial break line 42 divides the body 12 into a first section 44 and a second section 46. This line 42 defines a pair of mating sides 48 positioned adjacent to each other. The first 44 and second 46 sections are pivotally joined at the mating sides 48. The body 12 is foldable along the medial break line 42. A flexible joint 50 is attached to the first 44 and second 46 sections and pivotally couple the first section 44 and the second section 46 together. The flexible joint 50 is positioned on the bottom surface 16.

In use, the guitar support assembly 10 has a tab 34 that engages a handle of an amplifier. The tab 34 is designed to be secured in position between the handle of an amplifier and the amplifier box. The notch 28 receives the neck of a guitar. The guitar is retained in a vertical position between the inner side 30 and the pair of side sides 32 of the notch 28.

A guitar support assembly according to claim 1, wherein said upper and lower surfaces being affixed or embossed with marketing and promotional material including logos, pictures, band names, studio names, club names, venue names or vendor names.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A guitar support assembly configured to engage a handle of an amplifier and receive a neck of a guitar, said guitar support assembly comprising:

a body, said body having a perimeter edge having a front side, a rear side, a first lateral side and a second lateral side, said front side having a notch therein, said notch having an inner side and a pair of sides extending from said inner side to said front side, each of said pair of sides tapering toward a respective one of said first and second lateral sides, said notch in said front side configured for receiving the neck of the guitar, said first and second lateral sides tapering toward each other from said rear side to said front side;

a tab extending away from said rear side, said tab being spaced from each of said first lateral side and said second lateral side, said tab being co-planar with said body, said tab being configured to engage the handle of the amplifier;

a medial break line dividing said body into a first section and a second section, said first section and said second section defining a pair of mating sides positioned adjacent to each other, said first and second sections being pivotally joined at said pair of mating sides, said body being foldable along said medial break line, each of said first section and said second section having an upper surface and a lower surface, each of said upper and lower surfaces of said first section being planar, each of said upper and lower surfaces of said second section being planar;

a recess extending downwardly into said upper surface of said first section of said body, said recess being configured to receive a beverage container, said recess being positioned proximate said first lateral side, said recess having a bounding surface, said bounding surface being continuous;

a plurality of slots being disposed in said upper surface of said second section of said body, each of said plurality of slots being configured to receive a guitar pick, said plurality of slots being positioned proximate said second lateral side and forming a linear array;

a flexible joint being attached to said first and second sections and pivotally coupling said first section and said second section together, said flexible joint being positioned on said lower surface of said first section of said body and said lower surface of said second section of said body; and wherein said body is configured to be positioned on the amplifier such that said notch is configured to receive the neck of the guitar and retain the guitar in a vertical orientation.

* * * * *